US010242648B2

(12) United States Patent
Jun et al.

(10) Patent No.: US 10,242,648 B2
(45) Date of Patent: Mar. 26, 2019

(54) DISPLAY DEVICE AND LUMINANCE CORRECTION SYSTEM INCLUDING THE SAME

(71) Applicant: Samsung Display Co., Ltd., Yongin-si, Gyeonggi-do (KR)

(72) Inventors: Byung Geun Jun, Yongin-si (KR); Dan Bi Kim, Yongin-si (KR); Min Cheol Kim, Yongin-si (KR); In Hwan Kim, Yongin-si (KR); Ui Yeong Cha, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 153 days.

(21) Appl. No.: 15/173,352

(22) Filed: Jun. 3, 2016

(65) Prior Publication Data

US 2017/0116961 A1 Apr. 27, 2017

(30) Foreign Application Priority Data

Oct. 22, 2015 (KR) ..... 10-2015-0147290

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/029* (2013.01); *G09G 2320/0233* (2013.01); *G09G 2320/0626* (2013.01); *G09G 2320/0693* (2013.01); *G09G 2360/145* (2013.01)

(58) Field of Classification Search
USPC .... 345/207, 589, 509, 690, 77, 87; 358/505; 348/218.1, 47; 382/167, 274
See application file for complete search history.

(56) References Cited

U.S. PATENT DOCUMENTS

2009/0009831 A1* 1/2009 Pollard ..... G06T 3/4015 358/505
2009/0135211 A1 5/2009 Wang et al.
2009/0267876 A1* 10/2009 Kerofsky ..... G09G 3/2007 345/87
2009/0322891 A1* 12/2009 Kondo ..... G06T 3/4038 348/218.1

(Continued)

*Primary Examiner* — Thuy N Pardo
(74) *Attorney, Agent, or Firm* — Lewis Roca Rothgerber Christie LLP

(57) ABSTRACT

A luminance correction system includes: a display device that displays an image of a first grayscale value; an image capturing device that generates a first image and a second image by capturing the displayed image; and an image separator that generates a first high-frequency image by extracting a high-frequency image from the first image, and generates a second low-frequency image by extracting a low-frequency image from the second image, wherein the display device includes: an image corrector that generates a corrected image data by analyzing the first high-frequency image and the second low-frequency image to provide an analyzation result and by correcting an image data with respect to the displayed image in accordance with the analyzation result to generate the corrected image data; and a display unit including a plurality of pixels that emit light with luminance corresponding to the corrected image data.

16 Claims, 4 Drawing Sheets

(56) References Cited

U.S. PATENT DOCUMENTS

| | | | | |
|---|---|---|---|---|
| 2010/0053222 | A1* | 3/2010 | Kerofsky | G09G 3/3406 345/690 |
| 2011/0097012 | A1* | 4/2011 | Tatsumi | G09G 5/10 382/274 |
| 2012/0242716 | A1* | 9/2012 | Tanaka | H05B 33/0854 345/690 |
| 2013/0027521 | A1* | 1/2013 | DeLuca | G02B 27/22 348/47 |
| 2013/0307863 | A1* | 11/2013 | Waki | A61B 8/485 345/589 |
| 2015/0116387 | A1 | 4/2015 | Jun | |
| 2015/0187054 | A1* | 7/2015 | Asano | G06T 5/006 382/167 |

* cited by examiner

DISPLAY DEVICE AND LUMINANCE CORRECTION SYSTEM INCLUDING THE SAME

CROSS-REFERENCE TO RELATED APPLICATION

This application claims priority to and the benefit of Korean Patent Application No. 10-2015-0147290, filed on Oct. 22, 2015 in the Korean Intellectual Property Office, the entire content of which is incorporated herein by reference.

BACKGROUND

1. Field

Embodiments of the present invention relate to a display device and a luminance correction system including the same.

2. Description of the Related Art

As information technology has developed, the importance of a display device, which is a connecting medium between a user and information, has increased. Accordingly, use of display devices, such as liquid crystal display devices and organic light emitting display devices, has increased.

The display devices may include a display panel including pixels that emit light, a data driver for providing data signals to the display panel, and a scan driver for providing scan signals to the display panel.

The respective pixels receive the data signals transmitted from the data driver in response to the scan signals, and emit light with luminance corresponding to the respective data signals. However, a luminance variation among the pixels may occur due to characteristics of the respective pixels and a manufacturing process variation. Therefore, in order to provide a display device with uniform image quality, a method of adjusting the luminance by measuring the luminance of the respective pixels has been developed.

The above information disclosed in this Background section is only for enhancement of understanding of the background of the invention and therefore it may contain information that does not form the prior art that is already known to a person of ordinary skill in the art.

SUMMARY

Aspects of embodiments of the present invention are directed toward a display device capable of providing uniform image quality by removing a luminance variation of an image that pixels display, and a luminance correction system in the same.

Further, aspects of embodiments of the present invention reduce a memory size used during a luminance correction process by applying luminance correction data with respect to an image of a specific grayscale to an image of another grayscale.

An exemplary embodiment of the present invention provides a luminance correction system, including: a display device that displays an image of a first grayscale value; an image capturing device that generates a first image and a second image by capturing the displayed image; and an image separator that generates a first high-frequency image by extracting a high-frequency image from the first image and generates a second low-frequency image by extracting a low-frequency image from the second image, wherein the display device may include: an image corrector that generates a corrected image data by analyzing the first high-frequency image and the second low-frequency image to provide an analyzation result and by correcting an image data with respect to the image depending on the analyzation result; and a display unit including a plurality of pixels that emit light with luminance corresponding to the corrected image data.

In some exemplary embodiments, the displayed image may include at least one of a red image, a green image, a blue image, and a white image.

In some exemplary embodiments, the image capturing device may generate the first image by capturing the displayed image including at least one color image selected from a red image, a green image, and a blue image as a black-and-white image.

In some exemplary embodiments, the image capturing device may generate the second image by capturing the displayed image including a white image as a black-and-white image.

In some exemplary embodiments, the image separator may extract images which are adjacent to each other among images displayed by the respective pixels and have a luminance difference greater than a reference luminance difference as the extracted high-frequency image.

In some exemplary embodiments, the image separator may extract images, which have luminances that gradually increase or decrease depending on their arrangement order among images displayed by the respective pixels, as the extracted low-frequency image.

In some exemplary embodiments, the image corrector may include: a luminance correction determiner that generates high-frequency determination information to correct a luminance variation included in the extracted high-frequency image by analyzing the first high-frequency image, and generates low-frequency determination information to correct a spot in the extracted low-frequency image by analyzing the second low-frequency image; and an image data corrector that generates the corrected image data by correcting the image data based on the high-frequency determination information and the low-frequency determination information.

In some exemplary embodiments, the luminance correction determiner may select pixels at set positions among first pixels of the pixels, the first pixels being configured to display the first high-frequency image, compare a first luminance of an image, which the selected pixels at the set positions display, with a first reference luminance to determine a change value of the first luminance, and generate the high-frequency determination information including the change value of the first luminance.

In some exemplary embodiments, the luminance correction determiner may determine a change value of a second luminance by comparing the second luminance of the low-frequency image, which each second pixel of the pixels is configured to display, with a second reference luminance, and may generate the low-frequency determination information including the change value of the second luminance.

In some exemplary embodiments, the image data corrector may generate the corrected image data by correcting luminance of the image data based on a change value of a first luminance of the high-frequency image in the high-frequency determination information and a change value of a second luminance of the low-frequency image in the low-frequency determination information.

In some exemplary embodiments, the image data corrector may correct the image data with respect to an image of a second grayscale value using the high-frequency determination information and the low-frequency determination information.

Another embodiment of the present invention provides a display device that receives a first high-frequency image and a second low-frequency image from an external device that captures an image of a first grayscale value displayed in the display device, the display device including: an image corrector that generates a corrected image data by respectively analyzing the first high-frequency image and the second low-frequency image to provide an analyzation result and by correcting an image data with respect to the displayed image depending on the analyzation result; a data driver that generates data signals based on the corrected image data; and a display unit including pixels configured to emit light with luminance respectively corresponding to the data signals.

In some exemplary embodiments, the image may include at least one of a red image, a green image, a blue image, and a white image.

In some exemplary embodiments, the first high-frequency image and the second low-frequency image may each include a black-and-white image.

In some exemplary embodiments, the first high-frequency image may include images which are adjacent to each other among images displayed by the respective pixels and have a luminance difference greater than a reference luminance difference.

In some exemplary embodiments, the second low-frequency image may include images with luminances which gradually increase or decrease depending on their arrangement order among images displayed by the respective pixels.

In some exemplary embodiments, the image corrector may include: a luminance correction determiner that generates high-frequency determination information to correct a luminance variation in the displayed image by analyzing the first high-frequency image, and generates low-frequency determination information to correct a spot in the displayed image by analyzing the second low-frequency image; and an image data corrector that generates the corrected image data by correcting the image data based on the high-frequency determination information and the low-frequency determination information.

In some exemplary embodiments, the image data corrector may correct the image data with respect to an image of a second grayscale value by using the high-frequency determination information and the low-frequency determination information.

According to the exemplary embodiment of the present invention, it is possible to perform luminance correction with respect to an original image by extracting a low-frequency image and a high-frequency image from the original image captured by an image capturing device and by using information respectively provided from the low-frequency image and the high-frequency image. Therefore, a display device and a luminance correction system included in the same according to the exemplary embodiment of the present invention are capable of generating a uniform luminance image from which a spot is removed.

Further, the display device and the luminance correction system in the same according to the exemplary embodiment of the present invention can use a corrected data with respect to an image of a set grayscale value as a corrected data with respect to an image of another grayscale value, thereby reducing a memory size used during a luminance correction process.

DETAILED DESCRIPTION

Figure 1:
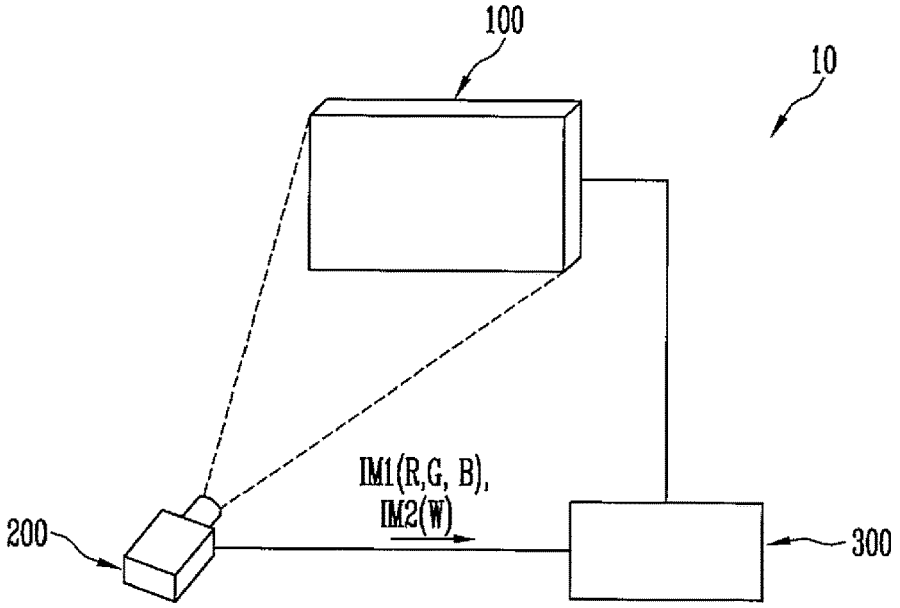
FIG. 1 illustrates a schematic view of a luminance correction system according to an exemplary embodiment of the present invention.

A specific structural or functional description of exemplary embodiments according to the present invention disclosed herein is exemplarily made to describe the exemplary embodiments according to the concept of the present invention, and the exemplary embodiments according to the present invention may be practiced in various suitable forms without being limited to the exemplary embodiments described herein.

Because the exemplary embodiments according to the concept of the present invention may have various suitable modifications and various suitable forms, the exemplary embodiments will be illustrated in the drawings and be fully described in the present specification. However, it is to be understood that the exemplary embodiments according to the concept of the present invention are not limited to the specific forms of this disclosure but include all suitable modifications, equivalents, and substitutions included in the spirit and scope of the present invention.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the present invention.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Unless indicated otherwise, it is to be understood that all the terms used in the specification including technical and scientific terms have the same or substantially the same meaning as those that are understood by persons skilled in the art. Unless otherwise defined, it should be understood that the terms defined by the dictionary are the same as or substantially the same as the meanings within the context of the related art, and they should not be defined in an ideal or excessively formal manner.

An image described by the exemplary embodiment of the present invention may refer to an image displayed by one pixel or images collectively displayed by a plurality of pixels.

Hereinafter, exemplary embodiments of the present invention will be described in detail with reference to the accompanying drawings.

FIG. 1 illustrates a schematic view of a luminance correction system according to an exemplary embodiment of the present invention.

Referring to FIG. 1, a luminance correction system 10 according to the exemplary embodiment of the present invention includes a display device 100, an image capturing device 200, and an image separator 300. Hereinafter, a luminance correction method of the luminance correction system 10 will be schematically described.

The display device 100 may display an image of one grayscale value among displayable grayscale values (e.g., grayscale values of 0 to 225). Further, the display device 100 may display an image of a specific color with respect to the one grayscale value.

For example, the display device 100 may display an image of a grayscale value 51 among the displayable grayscale values (e.g., grayscale values of 0 to 225). In this case, the display device 100 may display at least one of a red image of grayscale 51, a green image of grayscale 51, a blue image of grayscale 51 and a white image of grayscale 51.

For better understanding and ease of description, a red image, a green image, and a blue image of a first grayscale captured by the image capturing device 200 are referred to as a first image (IM1 (R, G, and B)) and a white image of the first grayscale captured by the image capturing device 200 is referred to as a second image (IM2 (W)).

The image capturing device 200 may capture the image that the display device 100 displays. According to the exemplary embodiment of the present invention, the image capturing device 200 is implemented with a black-and-white camera, and the first image (IM1 (R, G, and B)) and the second image (IM2 (W)) that the image capturing device 200 captures may both be black-and-white images.

The image capturing device 200 may transmit the first image (IM1 (R, G, and B)) and the second image (IM2 (W)) to the image separator 300.

The image separator 300 may generate a first high-frequency image (H_IM1 (R, G, and B)) by extracting a high-frequency image from the first image (IM1 (R, G, and B)), and may generate a second low-frequency image (L_IM2 (W)) by extracting a low-frequency image from the second image (IM2 (W)).

The image separator 300 may transmit the first high-frequency image (H_IM1 (R, G, and B)) and the second low-frequency image (L_IM2 (W)) to the display device 100.

Here, when luminance of an image displayed in a pixel of the display device 100 is compared with luminance of an image displayed in a pixel adjacent thereto, the high-frequency image refers to a set of the images that have a greater luminance difference than a reference luminance difference (e.g., a predetermined reference luminance difference). That is, among the images displayed by the respective pixels, the images of which luminance difference between the adjacent images is greater than the reference luminance difference are referred to as the high-frequency image.

Further, the low-frequency image refers to a set of the images, luminances of which gradually increase or decrease depending on their arrangement order.

In the exemplary embodiment shown in FIG. 1, the image separator 300 is illustrated as implemented outside the display device 100. However, in some exemplary embodiments, the image separator 300 may be implemented inside the display device 100.

The display device 100 may correct an image data by using the first high-frequency image (H_IM1 (R, G, and B)) and the second low-frequency image (L_IM2 (W)) transmitted from the image separator 300. The display device 100 may display the corrected image based on the corrected image data.

The display device 100 may display an image, a spot of which is removed and luminance of which is uniform, based on the corrected image data.

Figure 2:
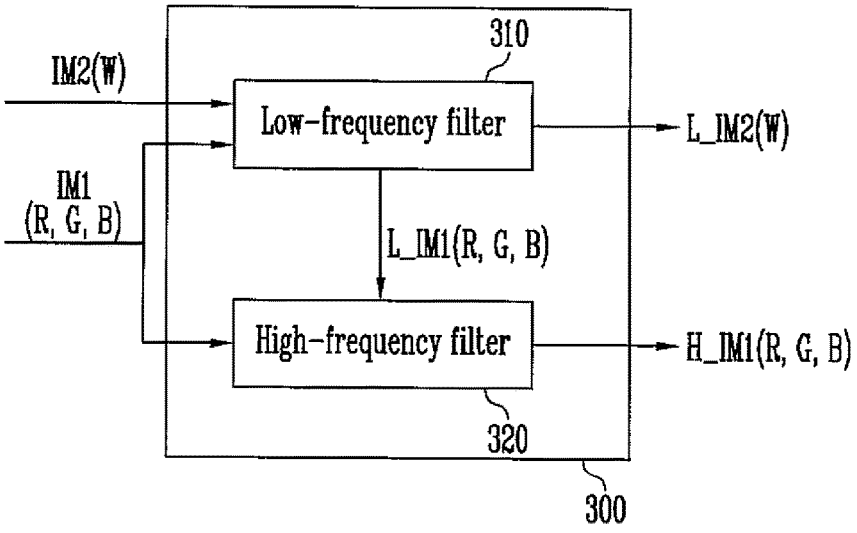
FIG. 2 illustrates a schematic block diagram of an image separator shown in FIG. 1.
Figure 3A:
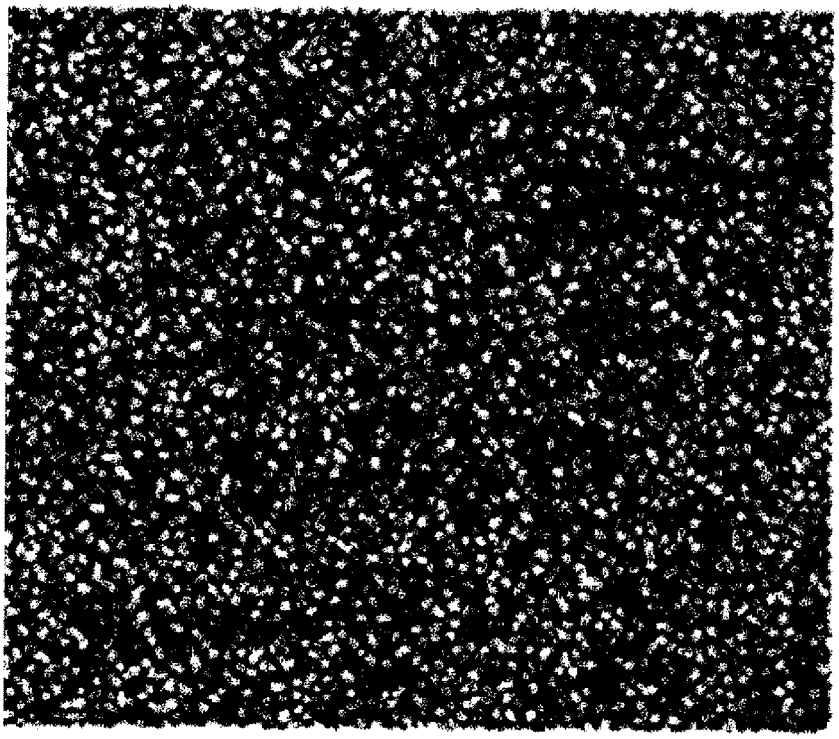
FIG. 3A represents a high-frequency image extracted by an image separator according to an exemplary embodiment of the present invention.
Figure 3B:
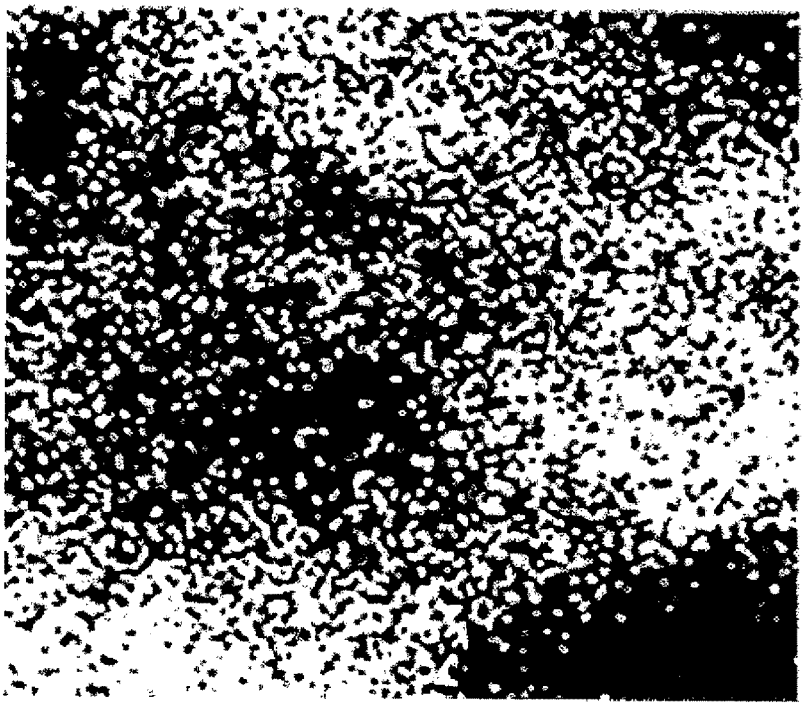
FIG. 3B represents a low-frequency image extracted by an image separator according to an exemplary embodiment of the present invention.

FIG. 2 illustrates a schematic block diagram of an image separator shown in FIG. 1, FIG. 3A represents a high-frequency image extracted by an image separator according to an exemplary embodiment of the present invention, and FIG. 3B represents a low-frequency image extracted by an image separator according to an exemplary embodiment of the present invention.

Referring to FIGS. 1, 2, 3A, and 3B, the image separator 300 may generate the first high-frequency image (H_IM1 (R, G, and B)) and the second low-frequency image (L_IM2 (W)) by using the first image (IM1 (R, G, and B)) and the second image (IM2 (W)) transmitted from the image capturing device 200.

The image separator 300 may include a low-frequency filter 310 and a high-frequency filter 320.

The low-frequency filter 310 according to the exemplary embodiment of the present invention may extract the low-frequency image from the first image (IM1 (R, G, and B)) and the second image (IM2 (W)).

The low-frequency filter 310 may generate the first low-frequency image (L_IM1 (R, G, and B)) by extracting the low-frequency image of the first image (IM1 (R, G, and B)) transmitted from the image capturing device 200. The low-frequency filter 310 may transmit the first low-frequency image (L_IM1 (R, G, and B)) to the high-frequency filter 320.

Further, the low-frequency filter 310 may generate the second low-frequency image (L_IM2 (W)) by extracting the low-frequency image of the second image (IM2 (W)) transmitted from the image capturing device 200. The low-frequency filter 310 may transmit the second low-frequency image (L_IM2 (W)) to the display device 100.

The high-frequency filter 320 may generate the first high-frequency image (H_IM1 (R, G, and B)) by using the first image (IM1 (R, G, and B)) transmitted from the image capturing device 200 and the first low-frequency image (L_IM1 (R, G, and B)) transmitted from the low-frequency filter 310.

That is, the high-frequency filter 320 may extract the high-frequency image by removing the low-frequency image from the first image (IM1 (R, G, and B)). The high-frequency filter 320 may transmit the first high-frequency image (H_IM1 (R, G, and B)) to the display device 100.

Figure 4:
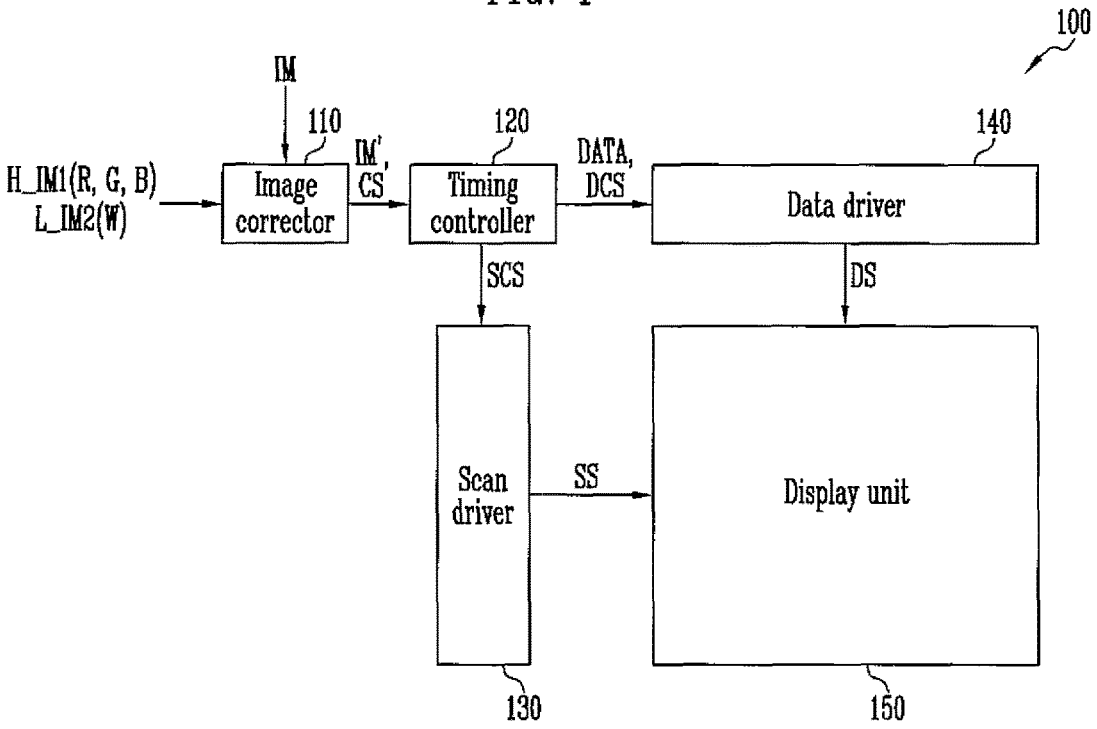
FIG. 4 illustrates a block diagram of the display device shown in FIG. 1.

FIG. 4 illustrates a block diagram of the display device shown in FIG. 1.

Referring to FIGS. 1 and 4, the display device 100 according to the exemplary embodiment of the present invention may include an image corrector 110, a timing controller 120, a scan driver 130, a data driver 140, and a display unit 150.

The image corrector 110 may correct an original image (IM) by using the first high-frequency image (H_IM1 (R, G, and B)) and the second low-frequency image (L_IM2 (W)) transmitted from the image separator 300. That is, the image corrector 110 may generate a corrected image data (IM') by analyzing the first high-frequency image (H_IM1 (R, G, and B)) and the second low-frequency image (L_IM2 (W)) to provide an analyzation result and by correcting the original image (IM) depending on the analyzation result to generate the corrected image data (IM'). Here, an initial image may be transmitted from a processor.

The image corrector 110 may transmit the corrected image data (IM') to the timing controller 120.

The timing controller 120 may generate a scan control signal (SCS) and a data control signal (DCS) using a control signal (CS) transmitted from the processor, and may generate data information (DATA) using the corrected image data (IM').

The timing controller 120 may transmit the scan control signal (SCS) to the scan driver 130.

The timing controller 120 may transmit the data information (DATA) and the data control signal (DCS) to the data driver 140.

The scan driver 130 may transmit scan signals (SS) to scan lines in response to the scan control signal (SCS).

The data driver 140 may generate data signals (DS) by using the data information (DATA) and the data control signal (DCS), and may transmit the data signals (DS) to data lines.

The display unit 150 is connected to the scan lines and the data lines, and includes the pixels that display the image.

For example, the display unit 150 may be an organic light emitting display panel, a liquid crystal display panel, or a plasma display panel, but is not limited thereto.

When the scan signals (SS) are provided to a scan line, the respective pixels may receive the data signals (DS) from the data lines, and may emit light with luminance corresponding to the data signals (DS).

In the exemplary embodiment shown in FIG. 4, the image corrector 110 is illustrated as being implemented outside the timing controller 120. However, in some exemplary embodiments, the image corrector 110 may be implemented inside the timing controller 120.

According to another exemplary embodiment, the image corrector 110 may be implemented inside the data driver 140.

Figure 5:
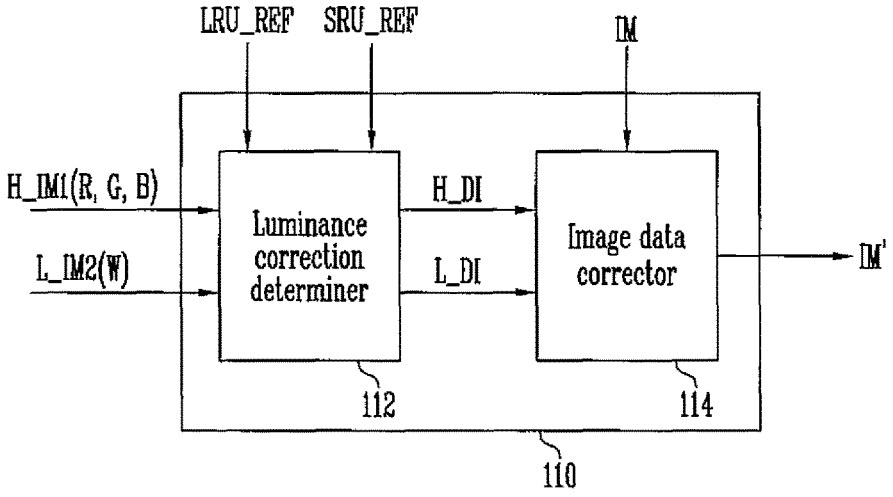
FIG. 5 illustrates a block diagram of an image corrector shown in FIG. 4.

FIG. 5 illustrates a block diagram of an image corrector shown in FIG. 4.

Referring to FIGS. 4 and 5, the image corrector 110 may include a luminance correction determiner 112 and an image data corrector 114.

The luminance correction determiner 112 may generate high-frequency determination information (H_DI) by analyzing the first high-frequency image (H_IM1 (R, G, and B)) transmitted from the image separator 300. That is, the luminance correction determiner 112 determines whether a luminance variation exists in the first high-frequency image (H_IM1 (R, G, and B)), and when the luminance variation exists, the high-frequency determination information (H_DI) for compensating the luminance variation may be generated.

Specifically, the luminance correction determiner 112 selects pixels at set positions (e.g., predetermined positions) among first pixels that display the first high-frequency image (H_IM1 (R, G, and B)), and may compare a first luminance of the high-frequency image displayed in the pixels with a first reference luminance (LRU_REF).

In this case, the luminance correction determiner 112 may generate the high-frequency determination information (H_DI) by determining a change value of the first luminance of the first high-frequency image (H_IM1 (R, G, and B)) displayed in the pixels depending on the compared result.

Here, the first reference luminance (LRU_REF) may include a reference luminance value with respect to each of the red image, the green image, and the blue image of the first grayscale.

The luminance correction determiner 112 may transmit the high-frequency determination information (H_DI) to the image data corrector 114.

The luminance correction determiner 112 may generate low-frequency determination information (L_DI) by analyzing the second low-frequency image (L_IM2 (W)) transmitted from the image separator 300. That is, the luminance correction determiner 112 determines whether a spot in the second low-frequency image (L_IM2 (W)) exists, and when the spot exists, the low-frequency determination information (L_DI) for removing the spot may be generated.

Specifically, the luminance correction determiner 112 may compare a second luminance of the second low-frequency image (L_IM2 (W)) that each of the second pixels display with a second reference luminance (e.g., a predetermined second reference luminance) (SRU_REF).

In this case, the luminance correction determiner 112 may generate the low-frequency determination information (L_DI) by determining a change value of the second luminance depending on the compared result. Here, the second reference luminance (SRU_REF) may include a reference luminance value with respect to the white image.

The luminance correction determiner 112 may transmit the low-frequency determination information (L_DI) to the image data corrector 114.

According to the exemplary embodiment, the first reference luminance (LRU_REF) and the second reference luminance (SRU_REF) may be values determined by the luminance correction determiner 112.

According to another exemplary embodiment, the first reference luminance (LRU_REF) and the second reference luminance (SRU_REF) may be values transmitted from the processor or the image separator 300.

The image data corrector 114 may generate the corrected image data (IM') by correcting luminance of the original image (IM) based on the high-frequency determination information (H_DI) and the low-frequency determination information (L_DI).

Accordingly, the image corrector 110 may perform luminance correction with respect to the original image (IM) by using information respectively received from the first high-frequency image (H_IM1 (R, G, and B)) and the second low-frequency image (L_IM2 (W)), and may generate a uniform luminance image, with the spot removed.

According to the exemplary embodiment, the image data corrector 114 may correct an image data with respect to an image of a second grayscale value by using the high-frequency determination information (H_DI) and the low-frequency determination information (L_DI) with respect to the image of the first grayscale value.

That is, the image data corrector 114 may compensate a spot and imbalance of luminance included in the image of the second grayscale value by using the high-frequency determination information (H_DI) and the low-frequency determination information (L_DI) with respect to the image of the first grayscale value.

Accordingly, the display device 100 according to the exemplary embodiment of the present invention uses the high-frequency determination information (H_DI) and the low-frequency determination information (L_DI) with respect to the image of the first grayscale value, thereby reducing the inconvenience of separately obtaining high-frequency determination information and low-frequency determination information to compensate the image of the second grayscale value and separately storing them.

Figure 6:
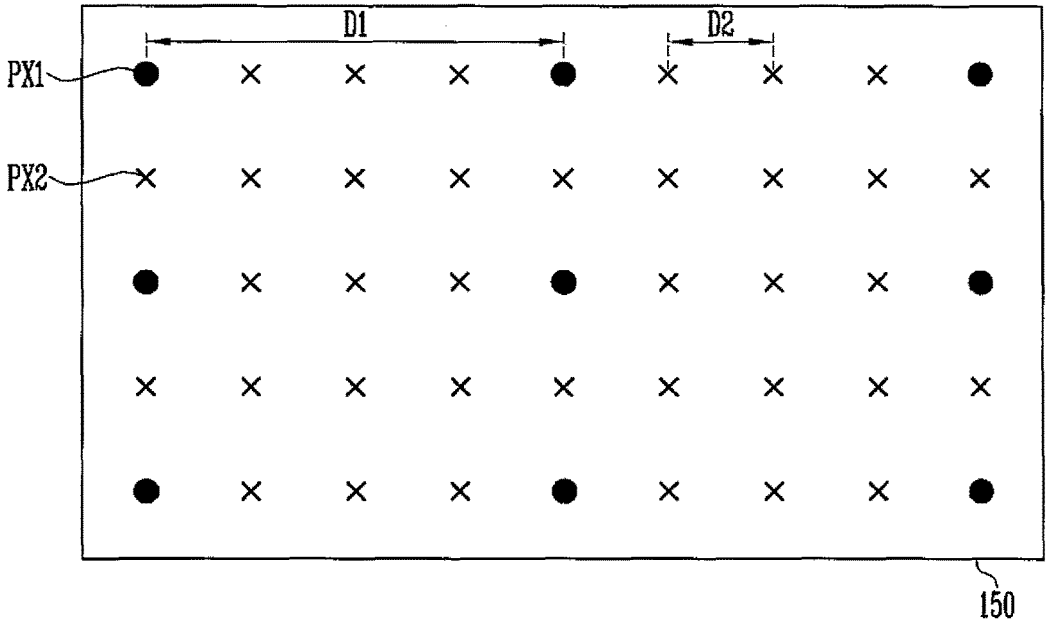
FIG. 6 illustrates a schematic view for explaining a method in which a display device according to an exemplary embodiment of the present invention generates high-frequency determination information and low-frequency determination information.

FIG. 6 illustrates a schematic view for explaining a method in which the display device according to the exemplary embodiment of the present invention generates the high-frequency determination information and the low-frequency determination information.

Referring to FIGS. 4, 5, and 6, first pixels PX1 displaying the first high-frequency image (H_IM1 (R, G, and B)) may be disposed to be spaced apart from each other at a first distance D1 within the display unit 150. Additionally, second pixels PX2 displaying the second low-frequency image (L_IM2 (W)) may be disposed to be spaced apart from each other at a second distance D2 within the display unit 150.

The luminance correction determiner 112 may obtain a high-frequency luminance parameter by analyzing the first high-frequency image (H_IM1 (R, G, and B)) that the respective first pixels display. That is, the luminance correction determiner 112 may generate the high-frequency luminance parameter by extracting a large luminance value (e.g., a maximum luminance value) and a small luminance value (e.g., a minimum luminance value) from the first high-frequency image (H_IM1 (R, G, and B)), and by using the large luminance value and the small luminance value.

The luminance correction determiner 112 may determine whether luminance correction of the first high-frequency image (H_IM1 (R, G, and B)) would be useful or not in comparison with the high-frequency luminance parameter and a reference luminance parameter (e.g., a predetermined reference luminance parameter).

The high-frequency luminance parameter may be determined according to the following mathematical formula.

$$k=(\min.L/\max.L)\times 100\%$$

Here, k represents a high-frequency luminance parameter, and min.L represents a small luminance value, and max.L represents a large luminance value.

For example, when the high-frequency luminance parameter has a smaller value than that of the reference luminance parameter, the luminance correction determiner 112 may determine the luminance of the first high-frequency image (H_IM1 (R, G, and B)) to be corrected.

When the luminance correction of the first high-frequency image (H_IM1 (R, G, and B)) is determined, the luminance correction determiner (112) may determine the change value of the first luminance by comparing the first luminance of the first high-frequency image (H_IM1 (R, G, and B)) that the respective first pixels PX1 display with the first reference luminance (LRU_REF). According to this method, the luminance correction determiner 112 may generate the high-frequency determination information (H_DI) including the change value of the first luminance.

The luminance correction determiner 112 may generate the low-frequency determination information (L_DI) by analyzing the second low-frequency image (L_IM2 (W)) that the respective second pixels PX2 display.

By comparing the second luminance of the second low-frequency image (L_IM2 (W)) that the respective second pixels PX2 display with the second reference luminance (SRU_REF), the luminance correction determiner 112 may determine the change value of the second luminance to make the second luminance of the second low-frequency image (L_IM2 (W)) the same or substantially the same as the second reference luminance (SRU_REF).

In this case, the luminance correction determiner 112 may determine the change value of the second luminance with respect to the entire second low-frequency image (L_IM2 (W)) that the respective second pixels PX2 display. According to this method, the luminance correction determiner 112 may generate the low-frequency determination information (L_DI) including the change value of the second luminance.

For better understanding and ease of description, as described above, the first pixels PX1 are disposed to be spaced apart from each other at the first distance D1, and the second pixels PX2 are disposed to be spaced apart from each other at the second distance D2. However, the respective first pixels PX1 may be disposed to be spaced apart from each other at different distances, and the respective second pixels PX2 may be disposed to be spaced apart from each other at different distances.

While this invention has been described in connection with what is presently considered to be practical exemplary embodiments, it is to be understood that the invention is not limited to the disclosed embodiments, but, on the contrary, is intended to cover various suitable modifications and equivalent arrangements included within the spirit and scope of the appended claims.

What is claimed is:

1. A luminance correction system, comprising:

a display device configured to display an image of a first grayscale value;

an image capturing device configured to generate a first image and a second image by capturing from the display device the image of the first grayscale value that the display device displays; and an image separator configured to generate a first high-frequency image by extracting a high-frequency image from the first image and to generate a second low-frequency image by extracting a low-frequency image from the second image, wherein the image separator is configured to extract images, which are adjacent to each other among images displayed by respective pixels and have a luminance difference greater than a reference luminance difference, as the extracted high-frequency image;

wherein the display device comprises:

an image corrector configured to generate a corrected image data by analyzing the first high-frequency image and the second low-frequency image to provide an analyzation result and by correcting an image data with respect to the image depending on an analyzation result; and a display unit comprising a plurality of pixels that are configured to emit light with luminance corresponding to the corrected image data.

2. The luminance correction system of claim 1, wherein the displayed image comprises at least one of:

a red image;

a green image;

a blue image; and a white image.

3. The luminance correction system of claim 1, wherein the image capturing device is configured to generate the first image by capturing the displayed image comprising at least one color image selected from a red image, a green image, and a blue image as a black-and-white image.

4. The luminance correction system of claim 1, wherein the image capturing device is configured to generate the second image by capturing the displayed image comprising a white image as a black-and-white image.

5. The luminance correction system of claim 1, wherein the image separator is configured to extract images, which have luminances that gradually increase or decrease depending on their arrangement order among images displayed by the respective pixels, as the extracted low-frequency image.

6. The luminance correction system of claim 1, wherein the image corrector comprises:

a luminance correction determiner configured to:

generate high-frequency determination information to correct a luminance variation in the extracted high-frequency image by analyzing the first high-frequency image; and generate low-frequency determination information to correct a spot in the extracted low-frequency image by analyzing the second low-frequency image; and an image data corrector configured to generate the corrected image data by correcting the image data based on the high-frequency determination information and the low-frequency determination information.

7. The luminance correction system of claim 6, wherein the luminance correction determiner is configured to:

select pixels at set positions among first pixels of the pixels, the first pixels being configured to display the high-frequency image;

compare a first luminance of an image, which the selected pixels at the set positions display, with a first reference luminance to determine a change value of the first luminance; and generate the high-frequency determination information comprising the change value of the first luminance.

8. The luminance correction system of claim 6, wherein the luminance correction determiner is configured to:

determine a change value of a second luminance by comparing the second luminance of the low-frequency image, which each second pixel of the pixels is configured to display, with a second reference luminance; and generate the low-frequency determination information comprising the change value of the second luminance.

9. The luminance correction system of claim 6, wherein the image data corrector is configured to generate the corrected image data by correcting luminance of the image data based on a change value of a first luminance of the high-frequency image in the high-frequency determination information and a change value of a second luminance of the low-frequency image in the low-frequency determination information.

10. The luminance correction system of claim 6, wherein the image data corrector is configured to correct the image data with respect to an image of a second grayscale value using the high-frequency determination information and the low-frequency determination information.

11. A display device configured to receive a first high-frequency image and a second low-frequency image from an external device that captures an image of a first grayscale value displayed in the display device, the display device comprising:

an image corrector configured to generate a corrected image data by respectively analyzing the first high-frequency image and the second low-frequency image to provide an analyzation result and by correcting an image data with respect to the image of the first grayscale value, that is captured from the display device while being displayed in the display device, depending on the analyzation result, wherein the first high-frequency image comprises images which are adjacent to each other among images displayed by respective pixels and have a luminance difference greater than a reference luminance difference;

a data driver configured to generate data signals based on the corrected image data; and a display unit comprising pixels configured to emit light with luminance respectively corresponding to the data signals.

12. The display device of claim 11, wherein the image comprises at least one of:

a red image;

a green image;

a blue image; and a white image.

13. The display device of claim 11, wherein the first high-frequency image and the second low-frequency image each comprise a black-and-white image.

14. The display device of claim 11, wherein the second low-frequency image comprises images with luminances which gradually increase or decrease depending on their arrangement order among images displayed by the respective pixels.

15. The display device of claim 11, wherein the image corrector comprises:

a luminance correction determiner configured to:

generate high-frequency determination information to correct a luminance variation in the displayed image by analyzing the first high-frequency image; and generate low-frequency determination information to correct a spot in the displayed image by analyzing the second low-frequency image; and an image data corrector configured to generate the corrected image data by correcting the image data based on the high-frequency determination information and the low-frequency determination information.

16. The display device of claim 15, wherein the image data corrector is configured to correct the image data with respect to an image of a second grayscale value by using the high-frequency determination information and the low-frequency determination information.

* * * * *